United States Patent [19]

Wolf et al.

[11] 3,988,076

[45] Oct. 26, 1976

[54] ROTARY VANE MACHINE WITH SPRING-BIASED VANES

[75] Inventors: Richard Wolf, Stuttgart; Kurt Latzina, Waldenbuch, both of Germany

[73] Assignee: Robert Bosch G.m.b.H., Stuttgart, Germany

[22] Filed: Jan. 17, 1975

[21] Appl. No.: 542,014

[30] Foreign Application Priority Data

Jan. 30, 1974 Germany ..... 2404317

[52] U.S. Cl. ..... 418/175; 418/177; 418/186; 418/240; 418/270

[51] Int. Cl.[2] ..... F01C 1/00; F01C 21/00

[58] Field of Search ..... 418/258, 175, 177, 186, 418/240, 270, 187; 173/169

[56] References Cited

UNITED STATES PATENTS

| | | | |
|---|---|---|---|
| 202,882 | 4/1878 | Starkenberg | 418/258 |
| 868,374 | 10/1907 | Thomure | 418/186 |
| 1,923,600 | 8/1933 | Warner | 418/258 |
| 1,996,875 | 4/1935 | McCann | 418/258 |
| 2,204,460 | 6/1940 | Wunsch | 418/175 |
| 2,367,326 | 1/1945 | Beckman | 418/258 |
| 2,401,190 | 5/1946 | Reynolds | 418/270 |
| 3,045,899 | 7/1962 | Maher et al. | 41/258 |
| 3,406,634 | 10/1968 | Ounsted | 418/175 |

*Primary Examiner*—John J. Vrablik
*Attorney, Agent, or Firm*—Michael J. Striker

[57] ABSTRACT

An inner component of the fluid machine has an outer circumferential surface, and an outer component has an inner circumferential surface which eccentrically surrounds the outer circumferential surface. One of the components is rotatable relative to the other component. The inner component is formed with at least two pair of diametrically opposite guide slots each having an outer end open at the outer circumferential surface and an inner end, the inner ends communicating with one another and each of the guide slots receiving a sliding vane. The sliding vanes in the respective diametrically opposite guide slots are biased apart by at least one biasing spring located between inner ends of the guide slots.

10 Claims, 2 Drawing Figures

ROTARY VANE MACHINE WITH SPRING-BIASED VANES

BACKGROUND OF THE INVENTION

The present invention relates generally to fluid machines, and more particularly to an improved fluid machine and to a power tool driven by the same.

Rotary fluid machines of the sliding vane type are already known. They have two components one of which is eccentrically received within the other and one of which rotates with reference to the other. One of the components is formed with radial slots in which the vanes are slidably accommodated to engage the other component during the relative rotation. If the inner component is rotated, the vanes are urged outwardly into engagement with the inner surface bounding the cavity in the outer component by centrifugal force, and also in most instances by compressed air and/or springs which act upon the vanes. If the outer component rotates, centrifugal action is eliminated as a factor, but compressed air and/or springs are used.

Springs are used in the type of fluid motor having a rotatable inner component, only if the motor is to start immediately upon the application of pressure fluid without any slightest delay; they are not necessary for any other purposes. If the motor is of the type wherein the outer component rotates, however, the use of springs is of greater importance because no centrifugal force is available to urge the vanes into sealing engagement with the other component. This means that a uniform contact pressure of the vanes can then be obtained only by the use of springs, if it is desired that the contact pressure be independent of fluctuations in the pressurized air that is supplied.

Springs for biasing the vanes have been conceived as leaf springs and also as various steel wire springs of helical configuration. They all have the disadvantage that their deformation equals the total stroke of movement of each of the vanes, and that given the high number of revolutions of fluid machines of the type in question they are subjected to very high stresses which quite rapidly lead to material fatigue. This is particularly disadvantageous if such fluid machines are used in pneumatically operated hand tools because the motors are small and consequently the springs also must be small, and it is particularly disadvantageous if such a motor is of the type wherein the outer component is the one that rotates and wherein the reliable sealing contact of the vanes relies exclusively upon the proper operation of the springs.

SUMMARY OF THE INVENTION

It is a general object of this invention to overcome the disadvantages of the prior art.

More particularly, it is an object of this invention to provide a rotary fluid machine which is not possessed of these disadvantages.

A concomitant object of this invention is to provide such a rotary fluid machine wherein the springs that bias the sliding vanes are much less subject to stresses and consequently to material fatigue than in the prior art.

An additional object of the invention is to provide such an improved fluid machine wherein the reliable sealing engagement of the vanes with the associated component is assured over long periods of time.

A further object of the invention is to provide an improved hand-held power tool that is driven by a fluid machine of the type in question.

In keeping with these objects, and with others which will become apparent hereafter, one feature of the invention resides in a sliding-vane fluid machine which, briefly stated, comprises an inner component having an outer circumferential surface, and an outer component having an inner circumferential surface which eccentrically surrounds the outer circumferential surface, one of the components being rotatable relative to the other component. At least two pair of guide slots are formed in the inner component and each of the guide slots has an outer end open at the circumferential surface and an inner end. The guide slots of each pair are diametrically opposite each other and their inner ends communicate with one another. A sliding vane is located in each of the guide slots and has an inner edge face and an outer edge face. Biasing means has opposite ends which bear upon the inner edge faces of the sliding vanes in each pair of guide slots and which urge the outer edge faces of the vanes into engagement with the inner circumferential surface of the outer component.

It is important for purposes of the present invention that the number of guide slots and sliding vanes therein equals a whole number greater than two, and a preferred number is six.

It is already known to provide fluid operated motors having a ring-shaped outer component in which there is mounted eccentrically an inner component that is formed with a through-going slot in which two vanes are guided which are biased apart from one another by appropriate biasing means. This construction has the advantage that the biasing means becomes compressed and subsequently expanded again during each rotation only by the comparatively small amount resulting from the eccentric location of the inner component and the outer component; this amount is substantially less than the respective working stroke performed by the sliding vanes. However, this prior art construction has a decisive disadvantage, namely the fact that it utilizes a through-going slot and only two vanes; this makes the machine incapable of acting as a continuously operating motor and prevents it from producing an even remotely uniform amount of torque. For this reason such machines have never been used for any applications other than in circumstances where they must produce very brief torque peaks.

By resorting to the present application, however, we are able to provide a sliding-vane fluid machine which is capable of producing a continuous uniform torque, in that at least four, and preferably six, sliding vanes are provided wherein the vanes of each pair are mutually supported by one another via the biasing means. This construction avoids the disadvantages of the prior art but offers the advantage of the low stressing of the biasing means and therefore a longer life of the biasing springs.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
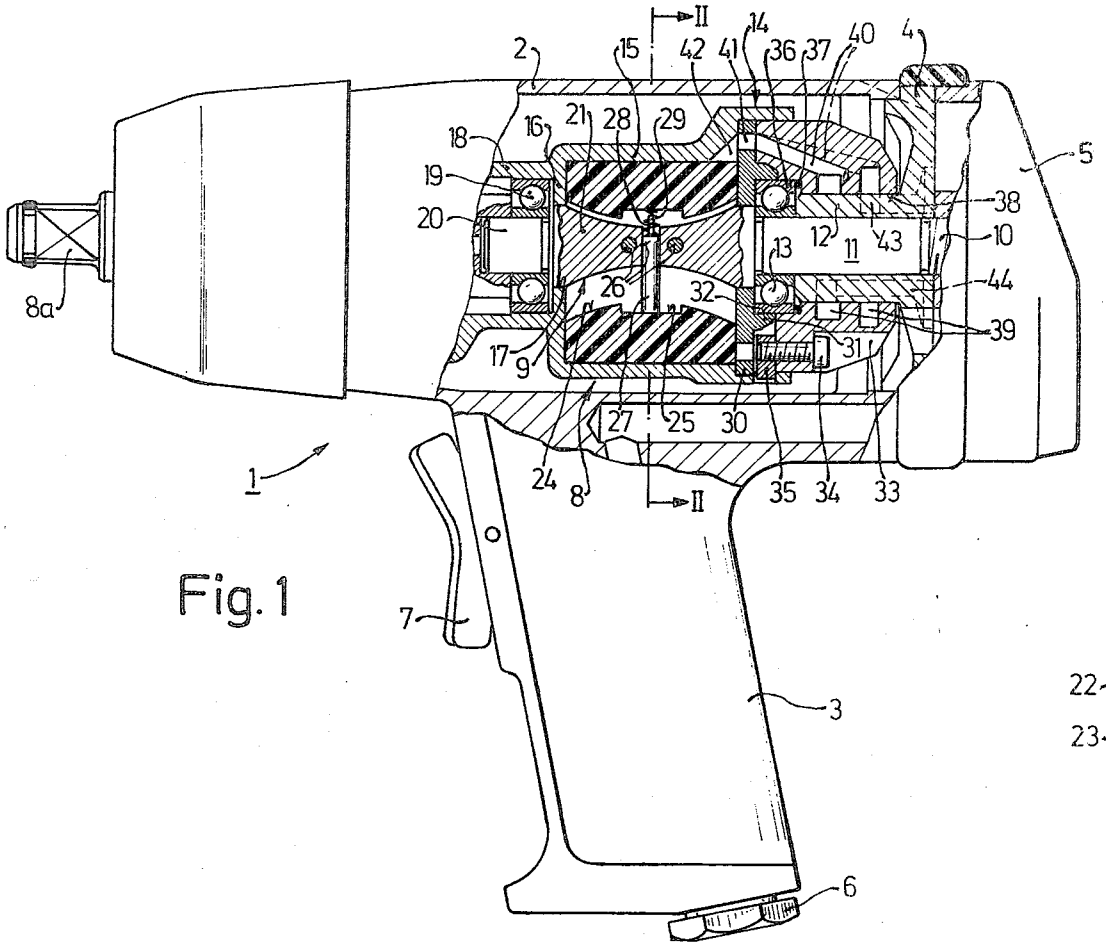
FIG. 1 is a side view, partly in section, illustrating a hand-held hammer drill powered by a sliding-vane fluid machine according to the present invention.

The power tool 1 has a housing 2 which is formed with a handle 3 for engagement by the hand of a user. The rear end of the tool (the term rear end refers to the end that faces the user whereas the term front end refers to the end that faces the workpiece) has an intermediate flange 4 that is mounted in the housing 2 and closed by a cover 5. An air inlet conduit 6 for compressed air is mounted in the handle 3 and is connected via a known illustrated switch that can be operated by a trigger 7 with a sliding-vane motor 8 that is accommodated in the housing 2 and is of the type wherein the outer component is the rotatable one. The motor 8 drives via non-illustrated intermediate components a tool spindle 8a.

Figure 2:
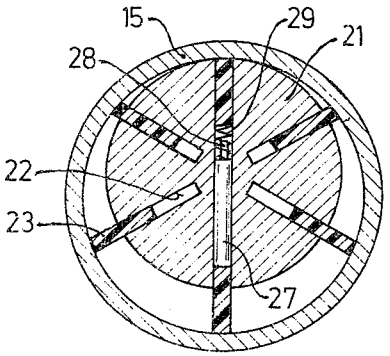
FIG. 2 is a sectional detail view taken on line II—II of FIG. 1.

As is more clearly evident from FIG. 2, the motor 8 has an inner component which is constructed as a stator 9 that has in the rearward region a threaded pin 10 by means of which it is threaded into the cover 5. Forwardly of the threaded pin 10 the stator 9 has a cylindrical part 11. The intermediate flange 4 is formed in the region of the stator 9 as a sleeve 12 which surrounds the cylindrical part 11 of the stator 9 over the major portion of its length. Forwardly of the sleeve 12 the cylindrical portion 11 is provided with an antifrication bearing 13 serving as a bearing for journalling the outer component 14 that constitutes the rotor. The outer component has a circumferential wall 15 which is essentially of cylindrical configuration and which at the forward end is formed with a transverse wall 16 having a center circular hole 17 and a sleeve 18 which is formed immediately ahead of the wall 16 with a constriction via which it is journalled with the aid of an antifriction bearing 19 on a cylindrical pin 20 forming the forward end of the stator 9. The bearing 19 acts as a floating bearing. The stator 9 is constructed as a cylindrical portion 21 of enlarged diameter intermediate the part 11 and the pin 20.

The components 9 and 14 are arranged eccentrically with reference to one another, as is clearly visible in FIG. 2. The cylindrical portion 21 is formed with six guide slots 22 which are equiangularly distributed over the circumferential surface of the cylindrical portion 21; the slots 22 are arranged in pairs of which the two slots always are located diametrically opposite one another. The bottoms of the guide slots 22 are of partcircular configuration, and each of the guide slots 22 accommodates a vane 23 in slidable relationship. The outer edge of each vane is straight and engages the inner circumferential surface of the wall 15, whereas the inner edge is arcuately curved on the line 24 and corresponds to the contour of the bottom of the respective guide slot 22. The arcuately curved inner edge 24 is interrupted centrally by a cutout 25 which is rectangular in the illustrated embodiment. The cylindrical portion 21 of the stator 9 is formed with three transverse bores 26 extending transversely to its longitudinal axis and which are axially offset relative to one another. Each of the bores 26 connects two of the guide slots 22 substantially midway of the latter, that is of the bottom wall of the latter. Each of the bores 26 accommodates a pin 27 which is formed with an axially extending pin 28 at one end, onto which a helical expansion spring 29 is pushed and mounted thereon. The expansion spring 29 projects beyond the free end of the pin 28. Each of the pins 27 engages with its end that is remote from the pin 28 one of the vanes 23, whereas the spring 29 engages with its free end the other vane 23 of the pair so that the spring pushes the two vanes apart from one another, assuring that the outer edges thereof are in uniform contact with the inner circumferential surface of the wall 15.

At the rear end the outer component 14 is closed by an end plate 30 that is inserted into the end face of the wall 15 and on which there is formed sleeve 31 whose inner cylindrical surface 32 supports the end plate 30 and therefore the outer component 14 on the bearing 13. From the rear end of the tool an air flange 33 is mounted on the plate 30 by means of screws 34 which engage nuts 35. The air flange 33 is provided at its front end in its interior with a cylindrical insert 36 by means of which it is supported on the outer race of the bearing 13. The screws 34 press the air flange 33 against the end plate 30 so that the two parts retain the outer race of the bearing 13 between themselves, a sealing ring 37 being interposed. The air flange 33 encloses with an inner cylindrical surface 38 thereof the sleeve 12 of the flange 4, a small amount of play being allowed between them. The inner cylindrical surface 38 is formed with two annular recesses or cutouts 39 which communicate via channels 40 with cutouts 41 formed in the end plate 30 and which in turn communicate with air pockets 42 formed in the wall 15, so that operating air is supplied to the receiving side of the outer component 14 and spent air is discharged from the discharging side thereof.

The sleeve 12 of the intermediate flange 4 is formed with substantially kidney-shaped slots 43 which are located opposite the grooves 39. Air channels 44 communicate the slots 43 via a non-illustrated switching valve and the earlier-mentioned switch with the air supply line 6.

This arrangement assures that the stator 9 which is formed with the several transverse slots and bores need not be weakened by the provision of air supply passages. Moreover, the exclusively radial supply of compressed air in both directions of rotation of the motor relieves the rotor (i.e., the component 14) of axial forces, and this is advantageous in terms of an improvement in the power supplied by the motor as well as in terms of an increase in the lifetime of the bearings and the vanes.

Of course, different biasing means than the ones illustrated could be provided, and the bores communicating the slots of each pair could be located differently, just as there could be more than one bore and more than one biasing means associated with each pair of diametrically opposite slots. The bores could also be replaced with slot-shaped passages or the like through which the biasing means can contact both vanes of a pair of diametrically opposite slots. The biasing means could be in form of one or more springs, and the pins illustrated could be omitted. The present invention is particularly applicable to hand-held power tools, but is not limited to them since it is not merely directed to a hand-held power tool having a novel sliding-vane fluid machine drive, but also to a novel sliding-vane fluid machine per se. In all instances, it is important, however, that the number of vanes is an even number greater than two, i.e., at least four or preferably even more, such as six.

It will be understood that each of the elements described above, or two or more together, may also find a useful application in other types of constructions differing from the type described above.

While the invention has been illustrated and described as embodied in a hand-held power tool, it is not intended to be limited to the details shown sinve various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint or prior art, fairly constitute essential characteristics of the generic or specific aspects of this invention.

What is claimed as new and desired to be protected by Letters Patent is set forth in the appended claims.

1. A portable pneumatic hand tool, comprising a portable housing; a tool chuck mounted on said portable housing; a fluid motor in said portable housing and comprising a rotary outer component having an inner circumferential surface and a stationary inner component having an outer circumferential surface which is eccentrically surrounded by said inner circumferential surface, said outer component being rotatable relative to said inner component and being connected in motion-transmitting relationship with said tool chuck; at least two pairs of guide slots formed in said inner component and each having an outer end open at said outer circumferential surface and an inner end, the guide slots of each pair being diametrically opposite each other; at least two passages formed in said inner component and each communicating the inner end of one guide slot of a pair with the inner end of the other guide slot of the same pair; a sliding vane in each of said guide slots and having an inner edge face and an outer edge face; and means for mutually supporting the sliding vanes in each pair of guide slots for simultaneous sliding movement in the respective passage, comprising biasing means having opposite ends bearing upon said inner edge faces of the sliding vanes in each pair of guide slots and urging said outer edge faces apart from each other and into engagement with said inner circumferential surface, whereby low stressing of said biasing means is obtained.

2. A portable pneumatic hand tool as defined in claim 1, wherein said passages are axially offset relative to one another in the center region of said vanes.

3. A portable pneumatic hand tool as defined in claim 1, wherein said passages are bores.

4. A portable pneumatic hand tool as defined in claim 1, wherein said biasing means comprises helical expansion springs.

5. A portable pneumatic hand tool as defined in claim 1, wherein said biasing means comprises pins each of which has a helical expansion spring secured thereto.

6. A portable pneumatic hand tool as defined in claim 1, said outer component having spaced axial ends, one of which is provided with a flange having a cylindrical surface formed with openings for radial admission and venting of compressed gaseous fluid.

7. A portable pneumatic hand tool as defined in claim 6, wherein said cylindrical surface is an inner cylindrical surface having openings formed therein as annular grooves.

8. A portable pneumatic hand tool as defined in claim 7; further comprising an outer cylindrical surface surrounded with slight clearance by said inner cylindrical surface and formed with slots which are each located oppositely one of said grooves to communicate therewith.

9. A portable pneumatic tool as defined in claim 1, wherein said inner ends of the guide slots are of part-circular configuration, and wherein said inner edge face of each sliding vane is arcuately curved and corresponds to said configuration of said inner ends of the guide slots.

10. A portable pneumatic tool as defined in claim 9, wherein said arcuately curved inner edge face of each vane is interrupted centrally by a rectangular cutout, said opposite ends of said biasing means being received in a respective cutout.

* * * * *